US006984015B2

(12) United States Patent
Lattuca et al.

(10) Patent No.: US 6,984,015 B2
(45) Date of Patent: Jan. 10, 2006

(54) INK JET PRINTHEADS AND METHOD THEREFOR

(75) Inventors: Michael D. Lattuca, Lexington, KY (US); Gregory A. Long, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 111 days.

(21) Appl. No.: 10/639,318

(22) Filed: Aug. 12, 2003

(65) Prior Publication Data

US 2005/0036003 A1 Feb. 17, 2005

(51) Int. Cl.
*B41J 2/015* (2006.01)

(52) U.S. Cl. ..... 347/20; 347/63; 347/65

(58) Field of Classification Search ..... 347/65, 347/63, 20

See application file for complete search history.

(56) References Cited

U.S. PATENT DOCUMENTS

| | | | |
|---|---|---|---|
| 3,756,875 | A | 9/1973 | Eccleston et al. |
| 4,693,781 | A | 9/1987 | Leung et al. |
| 4,807,013 | A | 2/1989 | Manocha |
| 4,835,115 | A | 5/1989 | Eklund |
| 4,863,560 | A | 9/1989 | Hawkins |
| 5,470,781 | A | 11/1995 | Chidambarrao et al. |
| 5,658,471 | A | 8/1997 | Murthy et al. |
| 6,375,858 | B1 | 4/2002 | Makigaki et al. |
| 6,402,301 | B1 | 6/2002 | Powers et al. |
| 6,412,921 | B1 | 7/2002 | Manini |
| 6,502,926 | B2 | 1/2003 | Cook et al. |
| 6,521,513 | B1 | 2/2003 | Lebens et al. |
| 6,527,368 | B1 | 3/2003 | Giri et al. |
| 6,555,480 | B2 | 4/2003 | Milligan et al. |
| 6,666,546 | B1 | 12/2003 | Buswell et al. |
| 6,814,431 | B2 * | 11/2004 | Buswell et al. ..... 347/65 |

FOREIGN PATENT DOCUMENTS

| | | |
|---|---|---|
| EP | 0227303 | 1/1987 |
| JP | 58168261 | 10/1982 |
| JP | 57186339 | 11/1982 |

* cited by examiner

*Primary Examiner*—Stephen Meier
*Assistant Examiner*—Ly T Tran
(74) *Attorney, Agent, or Firm*—Luedeka, Neely & Graham, P.C.

(57) ABSTRACT

A semiconductor substrate for an ink jet printhead. The substrate includes a silicon substrate having a thickness ranging from about 500 to about 900 microns and having a first surface and a second surface opposite the first surface. One or more ink feed slots are formed in the silicon substrate from the first surface to the second surface thereof. The ink feed slots have a first width dimension, opposing first ends, and a first length dimension between the opposing first ends adjacent the first surface of the substrate. Stress relieving openings are provided adjacent the opposing first ends of the ink feed slots. The stress relieving openings provide an overall feed slot length dimension, have a radius greater than the first width dimension of the ink feed slots and have a radius to first length dimension ratio ranging from about 1:60 to about 1:250.

18 Claims, 5 Drawing Sheets

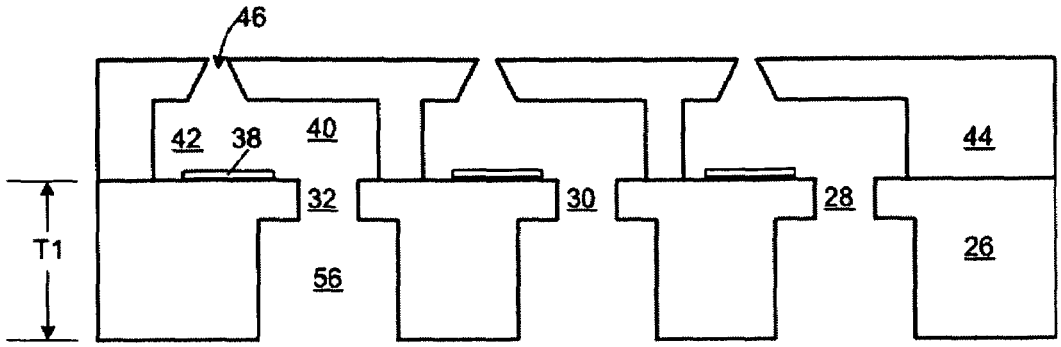
Fig. 6
Fig. 7
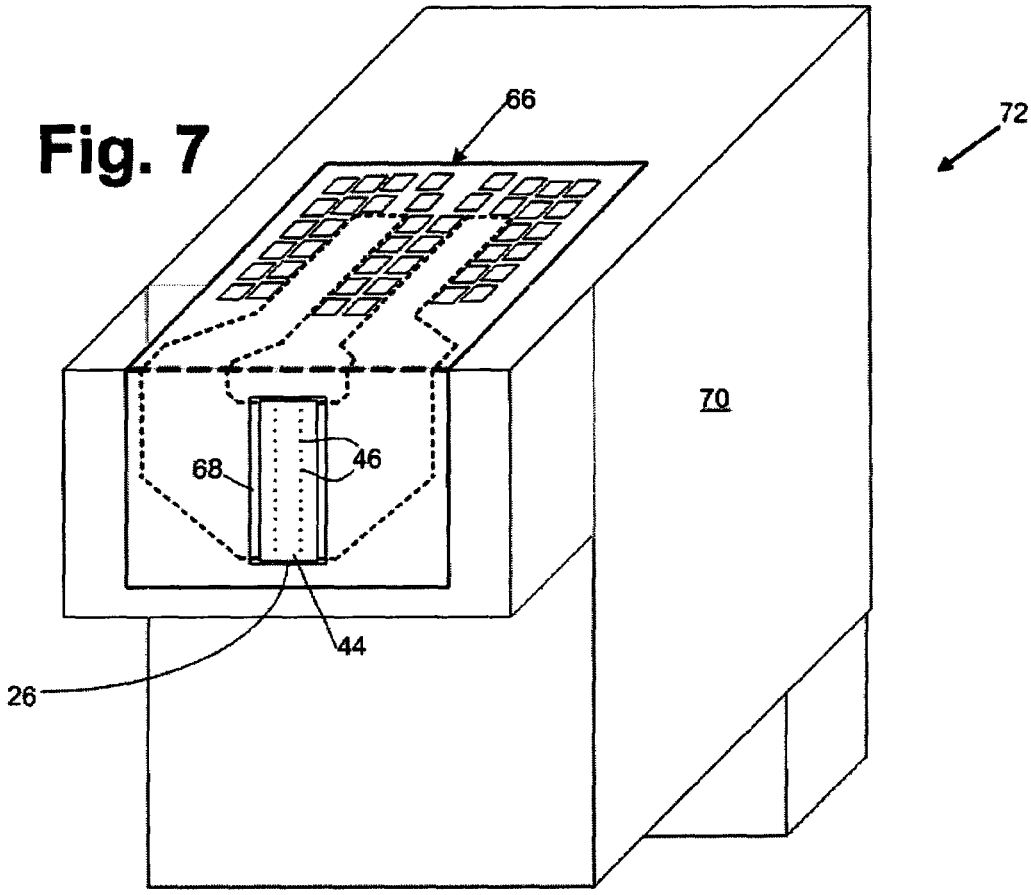

INK JET PRINTHEADS AND METHOD THEREFOR

FIELD OF THE INVENTION

The invention is directed to printheads for ink jet printers and more specifically to improved printhead structures and methods for making the structures.

BACKGROUND

Ink jet printers continue to be improved as the technology for making the printheads continues to advance. New techniques are constantly being developed to provide low cost, highly reliable printers which approach the speed and quality of laser printers. An added benefit of ink jet printers is that color images can be produced at a fraction of the cost of laser printers with as good or better quality than laser printers. All of the foregoing benefits exhibited by ink jet printers have also increased the competitiveness of suppliers to provide comparable printers in a more cost efficient manner than their competitors.

As advances are made in print quality and speed, a need arises for an increased number of ejection devices on the surface of the semiconductor substrate. There is also a desire to provide substrates that can eject more than one color ink. Multi-color ink substrates require multiple feed slots for providing different color inks to the associated ejection devices. Having multiple slots in a semiconductor substrate often weakens the substrate. In order to increase the strength of the substrate, the slots are often spaced-apart an amount sufficient to provide more substrate structure between the slots. However, increasing the spacing between the slots requires additional substrate area which increases the cost of the printheads. Thus, there continues to be a need for improved manufacturing processes and techniques which provide improved printhead components that can be provided at a lower cost.

SUMMARY OF THE INVENTION

With regard to the above and other objects the invention provides a semiconductor substrate for an ink jet printhead. The substrate includes a silicon substrate having a thickness ranging from about 500 to about 900 microns and having a first surface and a second surface opposite the first surface. One or more ink feed slots are formed in the silicon substrate from the first surface to the second surface thereof. The ink feed slots have a first width dimension, opposing first ends, and a first length dimension between the opposing first ends adjacent the first surface of the substrate. Stress relieving openings are provided adjacent the opposing first ends of the ink feed slots. The stress relieving openings provide an overall feed slot length dimension, have a radius greater than the first width dimension of the ink feed slots and have a radius to first length dimension ratio ranging from about 1:60 to about 1:250.

In another aspect the invention provides a method for making an ink jet printhead. The method includes providing a semiconductor substrate having a thickness ranging from about 500 to about 900 microns and having a first surface, and a second surface opposite the first surface. One or more ink feed slots are micromachined in the semiconductor substrate for ink flow communication from the second surface to the first surface of the substrate. The slots have a first width dimension, opposing first ends, and a first length dimension between the opposing first ends adjacent the first surface of the substrate. Stress relieving openings are micromachined adjacent the opposing ends of the ink feed slots. The stress relieving openings provide an overall feed slot length dimension and have a radius greater than the first width dimension of the ink feed slots. A nozzle plate is attached to the semiconductor substrate to provide the ink jet printhead.

An advantage of at least one of the embodiments of the invention is that multiple, relatively long ink feed slots can be provided in a relatively narrow silicon substrate while providing a substrate that is less prone to cracking or breaking. Without desiring to be bound by theory, it is believed that the stress relieving openings at the ends of the ink feed slots provide relieve for stress concentrations induced in the substrate during adhesive curing and cooling steps of a printhead manufacturing process. The openings also are effective to reduce stress concentrations induced in the substrate due to an impact load caused by dropping or striking an ink cartridge assembly containing the substrate.

For the purposes of the invention, the term "micromachining" shall include a wide variety of slot formation processes including, but not limited to, sand blasting, chemical etching, dry etching, deep reactive ion etching, laser ablation, and the like. Accordingly, the invention is adaptable to most conventional micromachining processes for forming openings or slots in semiconductor substrates.

BRIEF DESCRIPTION OF THE DRAWINGS

Further advantages of the invention will become apparent by reference to the detailed description when considered in conjunction with the figures, which are not to scale, wherein like reference numbers indicate like elements through the several views, and wherein:

FIG. 6 is a cross-sectional view, not to scale, through a semiconductor substrate and nozzle plate according to an embodiment of the invention;

FIG. 7 is a perspective view, not to scale, of an ink cartridge containing a semiconductor substrate according to an embodiment of the invention.

DETAILED DESCRIPTION OF THE INVENTION

Industry trends and competitive forces in the industry continue to drive manufacturers to reduce the cost of ink jet printheads and increase the print speed and quality. One method for decreasing the cost of the printheads is to provide narrower semiconductor substrates containing multiple ink feed slots formed therein. In order to increase print speed, the slots are usually made as long as possible so that more ink ejectors can be placed adjacent the slots for ejecting ink.

Figure 1:
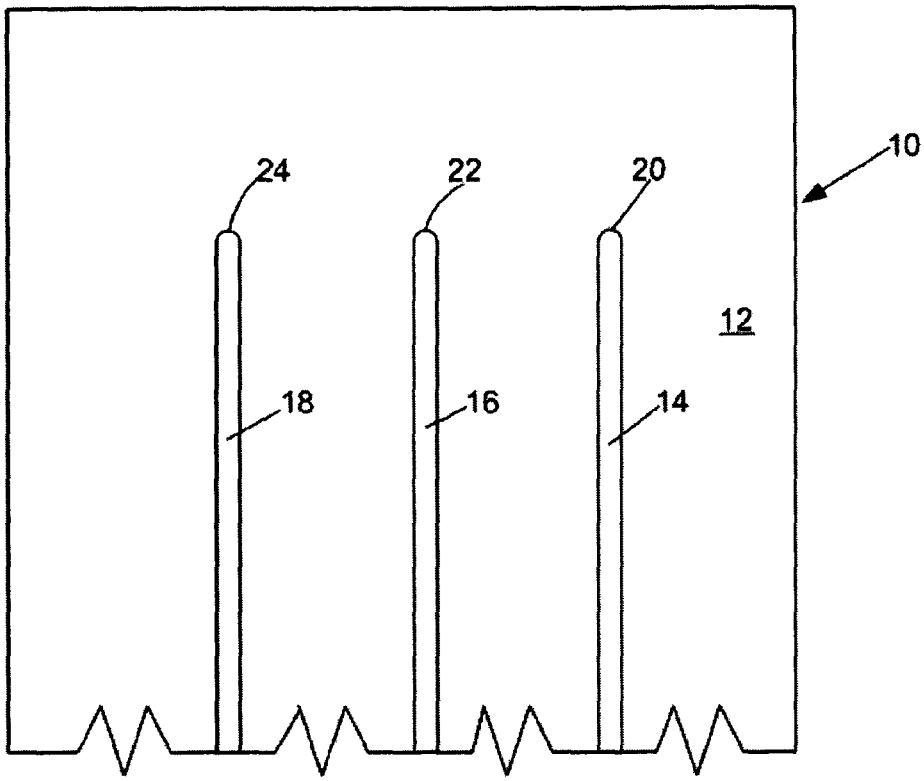
Fig. 1 Prior Art
FIG. 1 is a plan view not to scale of a conventional semiconductor chip for a printhead containing multiple ink feed slots.
Figure 2:
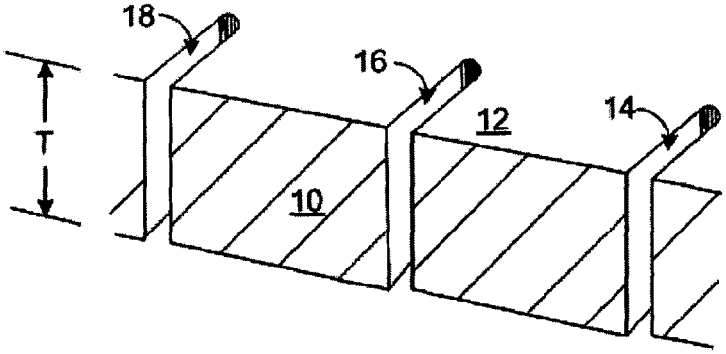
Fig. 2 Prior Art
FIG. 2 is a perspective, cross-sectional view, not to scale, of a conventional semiconductor chip for a printhead containing multiple ink feed slots.

A conventional semiconductor substrate 10 for an ink jet printhead containing multiple ink feed slots formed in a relatively narrow semiconductor substrate is illustrated in FIGS. 1 and 2. The substrate in FIG. 1 is viewed from device side 12 thereof and contains multiple ink feed slots 14, 16, and 18 formed through the thickness (T) of the substrate 10. Each of the ink feed slots 14, 16, and 18 preferably provides a different color ink to an ink ejector on the device surface 12 of the semiconductor substrate 10. The overall dimensions of the substrate are typically from about 3 to about 7 millimeters wide by from about 8 to about 15 millimeters long. However, chip lengths of up to about 30 millimeters are also contemplated by the invention.

As shown in FIGS. 1 and 2, the ink feed slots 14, 16, and 18 are relatively narrow, i.e., about 80 microns wide. Accordingly, ends 20, 22, and 24 of the ink feed slots 14, 16, and 18 have a relatively small radius. In the case of 80 micron wide ink feed slots 14, 16, and 18, the maximum radius of the ends 20, 22, and 24 is about 40 microns.

A disadvantage of the foregoing prior art design is that such substrates 10 are weaker and more likely to crack during the manufacturing process than wider substrates having shorter ink feed slots formed therein. Stress is introduced into the substrates 10 when the substrates 10 are attached to a plastic or metal ink cartridge body using a thermally curable adhesive. The substrates 10, typically silicon substrates 10, have a relatively low coefficient of thermal expansion compared to metals and plastics.

During the attachment process, the substrate 10 and cartridge body are heated to an elevated temperature sufficient to cure the adhesive. As the adhesive cures, the substrate 10 is locked in place on the cartridge body. As the substrate/cartridge body assembly cools to room temperature, the cartridge body often shrinks more than the substrate 10 creating a slight outward bowing of the substrate 10 away from the cartridge body. The stress due to such deformation of the substrate 10 tends to be greatest at the ends 20, 22, and 24 of the ink via. As a ratio of the radius of the ends 20, 22, 24 to a length of the ink vias 14, 16, and 18 decreases, the potential for cracking of the substrates 10 increases.

Additionally, striking or dropping the substrate 10 induces stresses in the substrate. Hence, the potential for cracking of the substrate 10 also increases when a cartridge assembly containing the substrate 10 is struck or dropped.

Figure 3:
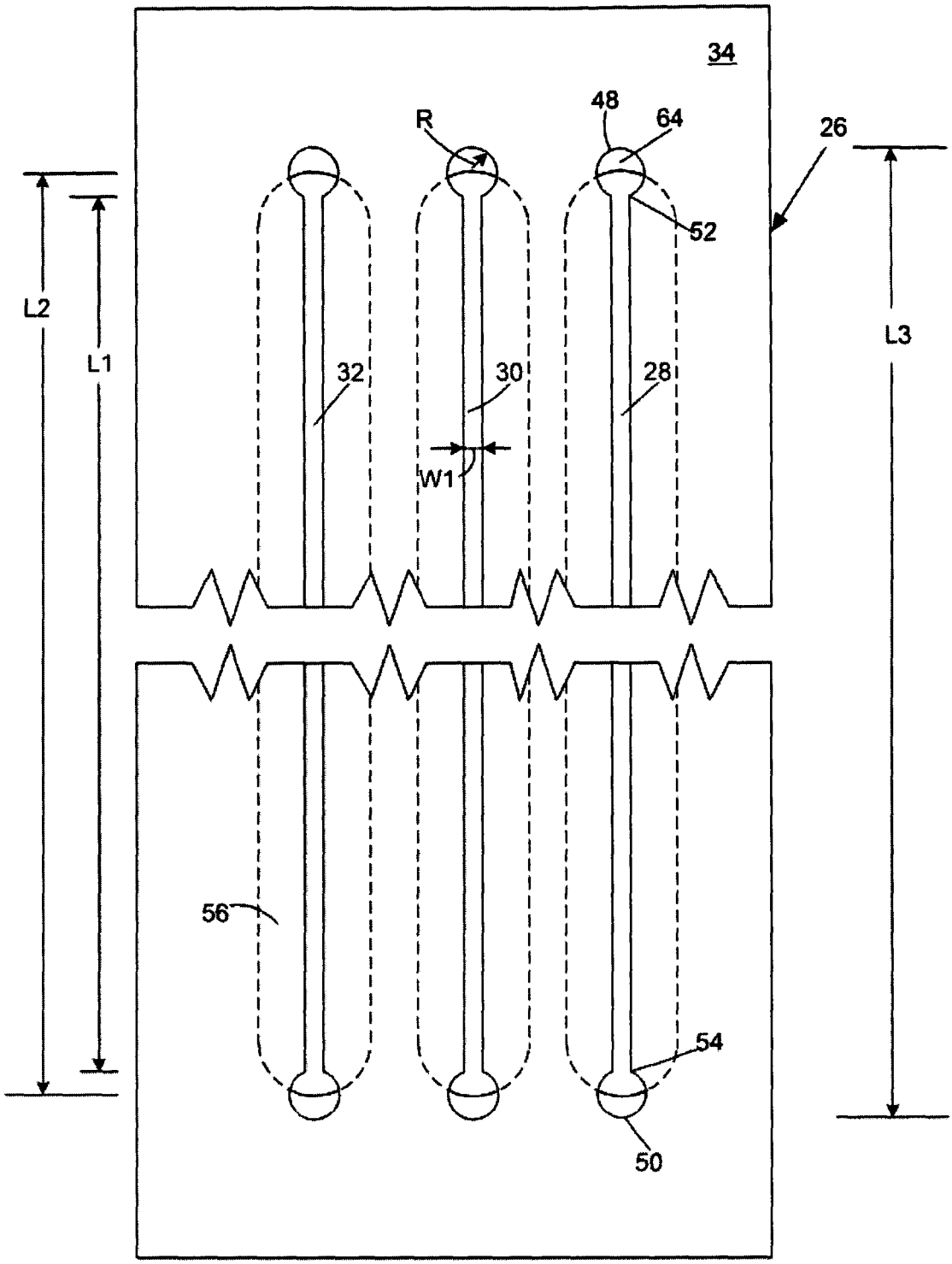
FIG. 3 is a plan view, not to scale, of a semiconductor chip according to an embodiment of the invention for a printhead containing multiple ink feed slots as viewed from a first surface of the chip.
Figure 4:
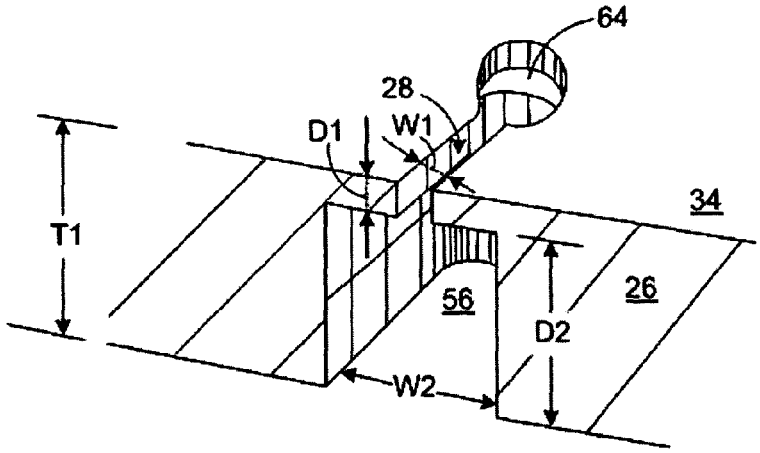
FIG. 4 is a perspective, cross-sectional view, not to scale, of a portion of a semiconductor chip according to an embodiment of the invention containing multiple ink feed slots.
Figure 5:
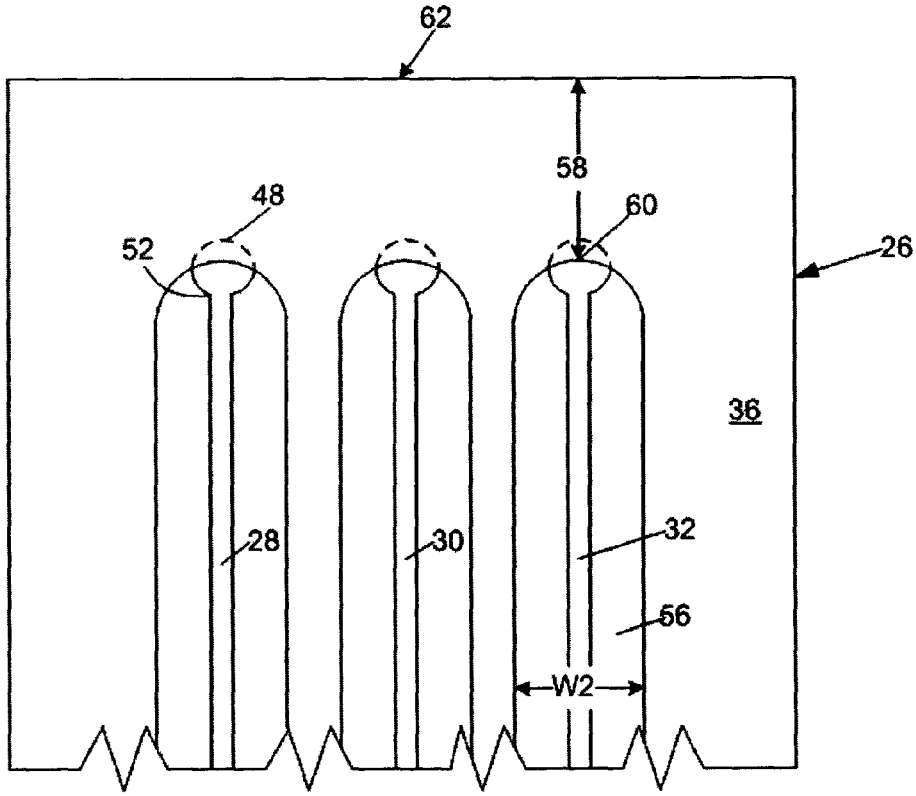
FIG. 5 is a plan view, not to scale, of a semiconductor chip according to an embodiment of the invention for a printhead containing multiple ink feed slots as viewed from a second surface of the chip.

With reference now to FIGS. 3–5, a semiconductor substrate 26 according to an embodiment of the invention is provided. The substrate 26 includes one or more ink feed slots, preferably at least two and most preferably at least three ink feed slots, such as slots 28, 30, 32, micromachined through a thickness (T1) of the substrate 26 extending between a first surface 34 (FIG. 3) and a second surface 36 (FIG. 5) thereof The ink feed slots 28, 30, and 32 provide ink flow communication between an ink reservoir and ink ejection devices on the first surface 34 of the substrate 26. Each of the ink feed slots 28, 30, and 32 may provide a different color ink to the ejection devices, or may all provide the same color ink to the ejection devices depending on the particular application.

The substrate 26 is preferably a silicon substrate having thickness (T1) ranging from about 500 to about 900 microns. Various metal insulating and passivating layers are deposited on the first surface 34 of the substrate to provide ink ejection devices and logic devices for ejecting ink from a printhead using the substrate 26.

Ink ejection devices 38 are typically disposed along a length (L1) of the ink feed slots 28, 30, and 32 on one or both sides thereof (FIG. 6). Ink is fed from the ink feed slots 28, 30, and 32 through ink channels 40 into ink chambers 42 in a thick film layer or nozzle plate 44 attached to the substrate 26. Upon activation of the ink ejectors 38, ink is caused to flow through nozzle holes 46 in the nozzle plate 44 toward a print media, such as a sheet of paper.

Referring again to FIG. 3, stress relieving openings 48 and 50 are provided on opposing ends 52 and 54 of each of the ink feed slots 28, 30, and 32. The stress relieving openings 48 and 50 preferably have a radius dimension (R) that is greater than a first width (W1) dimension of the ink feed slots 28, 30, and 32. The first width dimension (W1) of the ink feed slots 28, 30, and 32 preferably ranges from about 80 to about 250 microns, while the stress relieving openings 48 and 50 preferably have a radius dimension ranging from about 150 to about 300 microns.

With respect to the openings 52 and 54, a ratio of radius dimension (R) to the length (L1) of the ink feed slots 28, 30, and 32 preferably ranges from about 1:60 to about 1:250. While circular stress relieving openings 48 and 50 are shown, the invention is not limited to circular stress relieving openings 48 and 50. Accordingly, the stress relieving openings 48 and 50 may be substantially, circular, oval, or arcuate in shape, for example.

The slots 28, 30, and 32 and stress relieving openings 48 and 50 may be micromachined through the thickness (T1) of the substrate 26 with relatively constant first width (W1) and radius (R) dimensions using, for example, deep reactive ion etching (DRIE). However, in order to maximize the area of the surface 36 of the substrate 26 available for electrical tracing and logic devices, the slots 28, 30, and 32 are preferably formed in a two step micromachining process. In the two step micromachining process, a relatively narrow slot 28 having the first width dimension (W1) (FIG. 4) is formed from the device surface side 34 of the substrate 26. The relatively narrow slot 28 is preferably micromachined to a depth (D1) through the thickness (T1) of the substrate 26 that ranges from about 5 to about 50% of the thickness (T1) of the substrate 26.

In another micromachining process, a relatively wider slot 56 having a second width dimension (W2) is formed from the second surface 36 of the substrate 26. The relatively wider slot 56 is preferably formed to a depth (D2) through the thickness (T1) of the substrate 26 ranging from about 50 to about 95% of the thickness (T1) of the substrate 26. As shown in FIG. 3, the relatively wider slot 56 has a second length (L2) that is preferably greater than length (L1) of the slots 28, 30, and 30 between opposing ends 52 and 54 thereof. The relatively wider slot 56 is provided to reduce ink flow restriction through the thickness (T1) of the substrate 26.

The length (L2) of the relatively wider slot 56 is preferably less than an overall length (L3) provided by the ink feed slot 28 and openings 48 and 50. Accordingly, as shown in FIG. 5, there is provided additional supporting substrate area 58 between an end 60 of the relatively wider slot 56 and an edge 62 of the substrate 26. The additional supporting substrate area 58 is believed to resist deformation of the substrate 26 during manufacturing processes. Because the relatively wider slot 56 has a length dimension (L2) preferably less than the overall length dimension (L3) of the slots 28, 30, and 32, a shelf area 64 is provided in the slots 28, 30, and 32 as shown in FIGS. 3 and 4.

The slots 28, 30, and 32 and relatively wider slots 56 are preferably formed in the substrate 26 subsequent to depositing passivating, insulating, conductive, resistive, and protective layers on the substrate 26 to form the ink ejection devices such as heater resistors 38 on the surface 34 of the substrate. Next, the nozzle plate 44 is adhesively attached to the substrate 26 to provide a nozzle plate/substrate assembly 44/26 as shown generally in FIG. 6. A flexible circuit 66 (FIG. 7) is attached to the nozzle plate/substrate assembly 44/26 to provide a printhead 68. The printhead 68 is preferably adhesively attached to a cartridge body 70 to provide an ink jet cartridge 72 for use in an ink jet printer.

The nozzle plate 44 contains a plurality of the nozzle holes 46 each of which are in fluid flow communication with the ink chambers 42. The nozzle plate 44 is made of a material selected from metal such as nickel or a polymeric material such as a polyimide available from Ube Industries, Ltd of Tokyo, Japan under the trade name UPILEX. A preferred material for the nozzle plate 44 is a polymeric material and the nozzle holes 46 are made such as by laser ablating the polymeric material.

The nozzle plate 44 and ink chambers 42 are preferably aligned optically so that each nozzle hole 46 in the nozzle plate 44 aligns with one of the ink ejection devices 38 in the ink chamber 42. Misalignment between the nozzle holes 46 and the ink ejection device 38 may cause problems such as misdirection of ink droplets from the printhead 68, inadequate droplet volume or insufficient droplet velocity. Accordingly, nozzle plate/substrate assembly 44/26 alignment is critical to the proper functioning of an ink jet printhead 68.

A particularly preferred method for forming ink feed slots 28, 30, and 32 in a silicon semiconductor substrate 26 is a dry etch technique, preferably deep reactive ion etching (DRIE) or inductively coupled plasma (ICP) etching. This technique employs an etching plasma comprising an etching gas derived from fluorine compounds such as sulfur hexafluoride ($SF_6$), tetrafluoromethane ($CF_4$) and trifluoroamine ($NF_3$). A particularly preferred etching gas is $SF_6$. A passivating gas is also used during the etching process. The passivating gas is derived from a gas selected from the group consisting of trifluoromethane ($CHF_3$), tetrafluoroethane ($C_2F_4$), hexafluoroethane ($C_2F_6$), difluoroethane ($C_2H_2F_2$), octofluorobutane ($C_4F_8$) and mixtures thereof. A particularly preferred passivating gas is $C_4F_8$.

In order to conduct dry etching of the ink feed slots 28, 30, and 32 in the semiconductor substrate 26, the substrate 26 is preferably coated on the first surface 34 thereof with an etch stop material selected from $SiO_2$, a photoresist material, metal and metal oxides, i.e., tantalum, tantalum oxide and the like. Likewise, the substrate 36 is preferably coated on the second surface 36 with a protective layer or etch stop material selected from $SiO_2$, a photoresist material, tantalum, tantalum oxide and the like. The $SiO_2$ etch stop layer and/or protective layer may be applied to the first and second surfaces 34 and 36 of the silicon substrate 26 by a thermal growth method, sputtering or spinning. A photoresist material may be applied to the substrate 26 by spinning the photoresist material onto the first or second surfaces 34 and 36 of the substrate 26. The locations of the feed slots 28, 30, and 32 in the substrate 26 may be patterned in the substrate 26 from either side of the substrate 26, the opposite side being preferably provided with an etch stop material.

In a particularly preferred process, as described above, the ink feed slots 28, 30, and 32 are patterned and etched in the substrate 26 using a two step etching process. In the first step, the ink feed slots 28, 30, and 32 are etched from the first surface 34 of the substrate 26 to a depth, preferably less than about 50 microns. The first surface 34 is then coated with a photoresist layer or $SiO_2$ layer and the substrate 26 is dry etched from the second surface side 36 to complete the feed slots 28, 30, and 32 through the chip. As a result of the two-step process, the feed slot locations and sizes are more precise.

In order to conduct a deep reactive ion etching process, the patterned substrate 26 is placed in an etch chamber having a source of plasma gas and back side cooling such as with helium and water. It is preferred to maintain the substrate 26 below about 400° C., most preferably in a range of from about 50° to about 80° C. during the etching process. In the process, a deep reactive ion etch (DRIE) or inductively coupled plasma (ICP) etch of the silicon is conducted using an etching plasma derived from $SF_6$ and a passivating plasma derived from $C_4F_8$ wherein the substrate 26 is etched from the second surface 36 side toward the first surface 34 side.

During the etching process, the plasma is cycled between the passivating plasma step and the etching plasma step until the ink feed slots 28, 30, and 32 reach the etch stop layer on the first surface 34. Cycling times for each step preferably ranges from about 5 to about 20 seconds for each step. Gas pressure in the etching chamber preferably ranges from about 15 to about 50 millitorrs at a temperature ranging from about −20° to about 35° C. The DRIE or ICP platen power preferably ranges from about 10 to about 25 watts and the coil power preferably ranges from about 800 watts to about 3.5 kilowatts at frequencies ranging from about 10 to about 15 MHz. Etch rates may range from about 2 to about 10 microns per minute or more and produce slots 28, 30, and 32 having side wall profile angles ranging from about 88° to about 92°. Etching apparatus is available from Surface Technology Systems, Ltd. of Gwent, Wales. Procedures and equipment for etching silicon are described in European Application No. 838,839A2 to Bhardwaj, et al., U.S. Pat. No. 6,051,503 to Bhardwaj, et al., PCT application WO 00/26956 to Bhardwaj, et al.

When the etch stop layer $SiO_2$ on the first surface 34 is reached, etching of the ink feed slots 28, 30, and 32 terminates. The flow path through the ink feed slots 28, 30, and 32 may be completed by blasting through the etch stop layer on the surface 34 in the location of the ink feed slots 28, 30, and 32 using a high pressure water wash in a wafer washer. The finished substrate 26 preferably contains ink feed slots 28, 30, and 32 which are located in the substrate 26 so that feed slots 28, 30, and 32 are a distance ranging from about 40 to about 60 microns from their respective ink ejection devices 38.

In another embodiment, the relatively wide slot 56 may be formed in the second surface 36 of the substrate 26 by chemically etching the silicon substrate 26 prior to or subsequent to forming ink feed slots 28, 30, and 32 in the substrate 26. Chemical etching of wide slots 56 may be conducted using KOH, hydrazine, ethylenediamine-pyrocatechol-$H_2O$ (EDP) or tetramethylammonium hydroxide (TMAH) and conventional chemical etching techniques.

Prior to or subsequent to forming the wide slots 56, the ink feed slots 28, 30, and 32 are preferably formed in the silicon substrate 26 from the first surface 34 side as described above. When the wide slots 56 are made by chemical etching techniques, a silicon nitride (SiN) protective layer is preferably used to pattern the trench location on the second surface 36 side of the substrate 26. Upon completion of the slots 56 formation, a protective layer of SiO or other protective material for dry etching silicon is applied to the second surface 36 side of the substrate 26 to protect the silicon material during the dry etch process. The wide slots 56 are preferably etched in the substrate 26 to a depth of about 50 to about 300 microns or more. In the alternative, the wide slots 56 may be formed in the substrate 26 by grit blasting to the desired depth under carefully controlled conditions.

As compared to wet chemical etching, the dry etching techniques described above may be conducted independent of the crystal orientation of the silicon substrate 26 and thus ink feed slots 28, 30, and 32 may be placed more accurately in the substrates 26. While wet chemical etching is suitable for a substrate thickness of less than about 200 microns, the etching accuracy is greatly diminished for a substrate thickness greater than about 200 microns. The gases used for DRIE techniques according to the invention are substantially inert whereas highly caustic chemicals are used for wet chemical etching techniques. The shape of the ink feed slots 28, 30, and 32 made by DRIE is essentially unlimited whereas the shape of slots made by wet chemical etching is dependent on crystal lattice orientation. For example in a (100) silicon chip, KOH will typically only etch squares and rectangles without using advance compensation techniques. The crystal lattice does not have to be aligned for DRIE techniques.

The foregoing method for forming ink feed slots in a semiconductor substrate is described for example, in U.S. Pat. No. 6,402,301 to Powers et al., the disclosure of which is incorporated by reference thereto. Other methods for reactive ion etching are described in U.S. Pat. No. 6,051,503 to Haynes et al., incorporated herein by reference as if fully set forth. Useful etching procedures and apparatus are also described in EP 838,839 to Bhardwaj et al., WO 00/26956 to Bhardwaj et al. and WO 99/01887 to Guibarra et al. Etching equipment is available from Surface Technology Systems Limited of Gwent, Wales.

Figure 8:
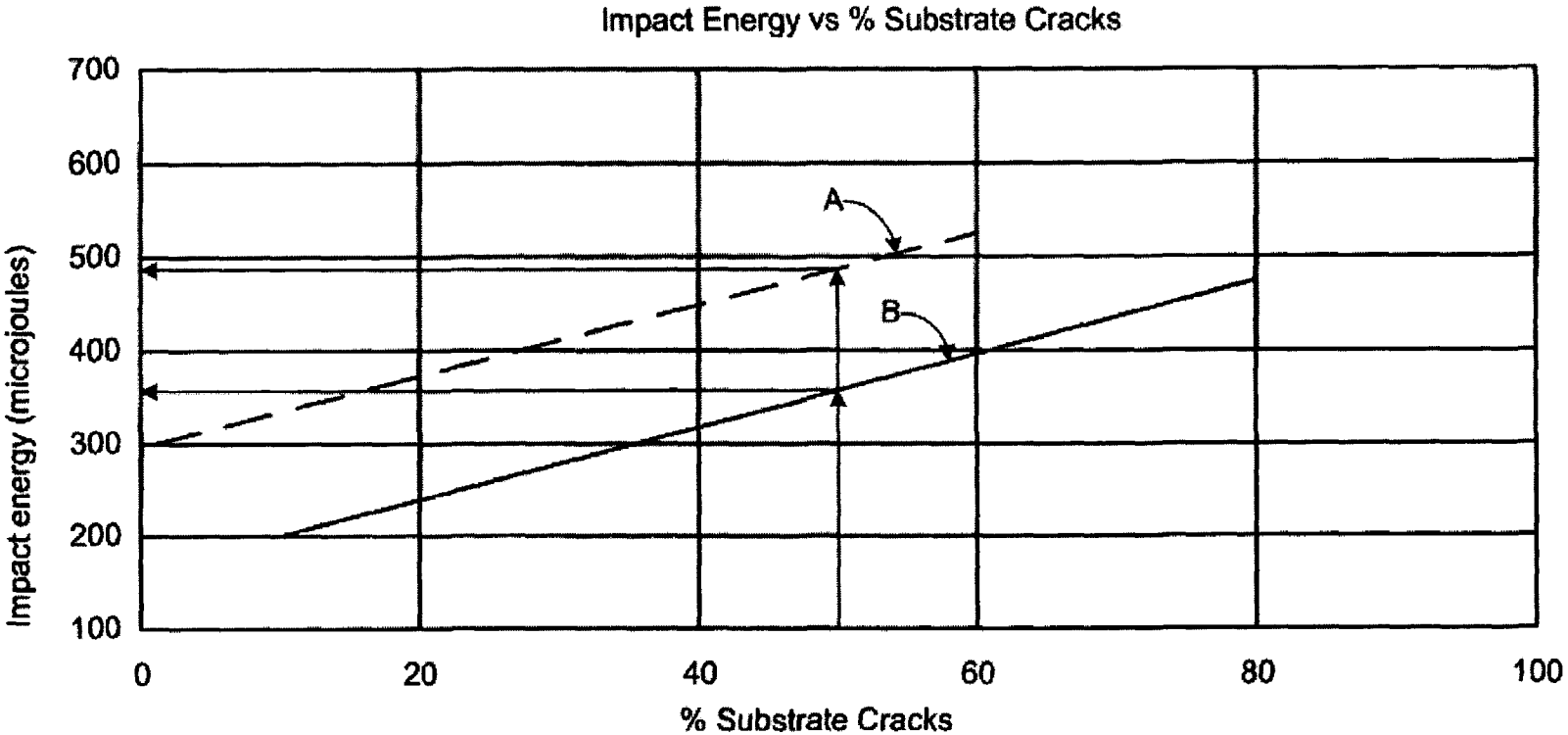
FIG. 8 is a graph of impact energy versus percentage substrate cracks comparing conventional substrates with a substrate according to the invention for various impact energies.

Semiconductor substrates having ink feed slots, such as substrate 26, made according to the invention have exhibited greater resistance to stress cracks than substrates made according to a conventional process. With reference to FIG. 8, substrates having slots made according to the invention (curve A) having stress relieving features can absorb about 25% more impact energy than substrates made according to the conventional process (Curve B) that do not have stress relieving features.

In order to compare the improved characteristics of substrates made according to the invention with conventional substrates, substrates without and without the stress relieving openings were attached to center portions of test plaques using die bond adhesives. The substrates were silicon substrates having a length of about 13.7 millimeters, a width of about 4.6 millimeters, and at least one ink feed slot with a width of about 0.11 millimeters. The test plaques to which the chips were attached were about 20 millimeters square and made of modified polyphenylene oxide polymer such as available from GE Plastics of Pittsfield, Mass. under the trade name NORYL.

In a test to determine how stresses in the substrates are affected by a load on the substrates, a five pound load was placed on the test plaque to which the substrate was attached in a hybrid three point bend test along the center-line of the test plaque with an axis parallel to the ink feed slot in the substrate and parallel to the lateral supports for the test plaque. The lateral supports for the test plaque were spaced about 8.7 millimeters from the center-line of the test plaque. The axis of the load only extended part way along an axis parallel with the lateral support axes. A comparison of substrates without and without stress relieving openings and substrates having openings of different size are contained in the following table.

TABLE 1

| Sample No. | Radius of Stress Relieving Opening (microns) | Maximum principal stress at end of ink feed slot (MPa) |
|---|---|---|
| 1 | None | 898 |
| 2 | 70 | 450 |
| 3 | 112 | 343 |
| 4 | 150 | 292 |

As shown by the foregoing results, substrates (Samples 2, 3 and 4) having stress relieving openings at the ends of the ink feed slots exhibited a significant decrease in stress under load compared to substrates (Sample 1) without stress relieving openings. The stress was decreased about 50% between Sample 1 and Sample 2, and about 67% between Sample 1 and Sample 4. The size of the stress relieving openings also had a beneficial effect on stress decrease. For example, substrates having slots with openings of 150 micron radius (Sample 4) at the ends of the slots exhibited a decrease in stress of about 35% compared to substrates having 70 micron radius openings at the ends of the slots.

Tests were conducted on substrates to determine stress in the substrates under thermal load. As above, the substrates were attached to test plaques using die bond adhesives. The ambient temperature was 110° C. and the test plaque assemblies were cooled down to 20° C. and the stresses were determined. The results are contained in the following table.

TABLE 2

| Sample No. | Radius of Stress Relieving Opening (microns) | Maximum principal stress at end of ink feed slot (MPa) |
|---|---|---|
| 1 | None | 6.34 |
| 2 | 95 | 5.06 |

As shown by the foregoing samples, a substrate (Sample 2) with a slot having stress relieving openings of 95 micron radius at the ends of the ink feed slots exhibited a decrease in thermally induced stress of about 20% over a substrate (Sample 1) that did not contain stress relieving openings at the ends of the ink feed slots.

It will be recognized by those skilled in the art, that the invention described above may be applicable to a wide variety of micro-fluid ejection devices other than ink jet printing devices. Such microfluid ejection devices may include liquid coolers for electronic components, micro-oilers, pharmaceutical delivery devices, and the like.

Having described various aspects and embodiments of the invention and several advantages thereof, it will be recognized by those of ordinary skills that the invention is susceptible to various modifications, substitutions and revisions within the spirit and scope of the appended claims.

What is claimed is:

1. A semiconductor substrate for an ink jet printhead, the substrate comprising, a silicon substrate having a thickness ranging from about 500 to about 900 microns and having a first surface, and a second surface opposite the first surface, one or more ink feed slots formed in the silicon substrate and extending from the first surface to the second surface thereof, each of the ink feed slots having a first width dimension, opposing first ends, and a first length dimension between the opposing first ends adjacent the first surface of the substrate, and a second width dimension, a second length dimension, and opposing second ends adjacent the second surface of the semiconductor substrate wherein the second width dimension is greater than the first width dimension and the second length dimension is greater than the first length dimension, and stress relieving openings adjacent the opposing first ends of each of the ink feed slots, wherein the stress relieving openings provide an overall feed slot length dimension, and have a radius greater than the first width dimension of the ink feed slot.

2. The semiconductor substrate of claim 1 comprising at least three ink feed slots formed therein.

3. The semiconductor substrate of claim 1 wherein the stress relieving openings have a radius to first length dimension ratio ranging from about 1:60 to about 1:250.

4. The semiconductor substrate of claim 3 wherein the second length dimension is less than the overall length dimension.

5. The semiconductor substrate of claim 3 wherein the second width dimension ranges from about 150 to about 300 microns.

6. The semiconductor substrate of claim 3 wherein the second width dimension is formed in the semiconductor substrate from the second surface thereof to a depth ranging from about 50 to about 95 percent of the substrate thickness.

7. The semiconductor substrate of claim 1 wherein the stress relieving openings have a circular radius ranging from about 115 to about 200 microns.

8. The semiconductor substrate of claim 7 wherein the ink feed slots have a first width dimension ranging from about 80 to about 150 microns.

9. An ink jet printhead containing a semiconductor substrate according to claim 1.

10. A semiconductor substrate for an ink jet printhead, the substrate comprising, a silicon substrate having a thickness ranging from about 500 to about 900 microns and having a first surface, and a second surface opposite the first surface, one or more ink feed slots having substantially parallel side walls formed in the silicon substrate and extending from the first surface to the second surface thereof, each of the ink feed slots having a first width dimension, opposing first ends, and a first length dimension between the opposing first ends adjacent the first surface of the substrate, and a second width dimension greater than the first width dimension, a second length dimension, and opposing second ends adjacent the second surface of the semiconductor substrate, and stress relieving openings adjacent the opposing first ends of each of the ink feed slots, wherein the stress relieving openings provide an overall feed slot length dimension, and have a radius greater than the first width dimension of the ink feed slots.

11. The semiconductor substrate of claim 10 comprising at least three ink feed slots formed therein.

12. The semiconductor substrate of claim 10 wherein the stress relieving openings have a radius to first length dimension ratio ranging from about 1:60 to about 1:250.

13. The semiconductor substrate of claim 10 wherein the second length dimension is greater than the first length dimension and less than the overall length dimension.

14. The semiconductor substrate of claim 10 wherein the second width dimension ranges from about 150 to about 300 microns.

15. The semiconductor substrate of claim 10 wherein the second width dimension is formed in the semiconductor substrate from the second surface thereof to a depth ranging from about 50 to about 95 percent of the substrate thickness.

16. The semiconductor substrate of claim 10 wherein the stress relieving openings have a circular radius ranging from about 115 to about 100 microns.

17. The semiconductor substrate of claim 16 wherein the ink feed slots have a first width dimension ranging from about 80 to about 150 microns.

18. An ink jet printhead containing a semiconductor substrate according to claim 10.

* * * * *